US011925831B2

(12) United States Patent
Johnson, III

(10) Patent No.: US 11,925,831 B2
(45) Date of Patent: Mar. 12, 2024

(54) ARM EXERCISE ATTACHMENT

(71) Applicant: Lloyd Johnson, III, St. Charles, MO (US)

(72) Inventor: Lloyd Johnson, III, St. Charles, MO (US)

( * ) Notice: Subject to any disclaimer, the term of this patent is extended or adjusted under 35 U.S.C. 154(b) by 0 days.

(21) Appl. No.: 17/409,806

(22) Filed: Aug. 24, 2021

(65) Prior Publication Data

US 2022/0233911 A1 Jul. 28, 2022

Related U.S. Application Data

(60) Provisional application No. 63/142,908, filed on Jan. 28, 2021.

(51) Int. Cl.
*A63B 22/00* (2006.01)
*A63B 21/00* (2006.01)
(Continued)

(52) U.S. Cl.
CPC .... *A63B 22/0012* (2013.01); *A63B 21/00069* (2013.01); *A63B 21/00192* (2013.01);
(Continued)

(58) Field of Classification Search
CPC ..... A63B 23/03525; A63B 23/035; A63B 23/03516; A63B 2022/067; A63B 2022/0676; A63B 2022/0082; A63B 2022/0041; A63B 21/4033; A63B 21/4035; A63B 21/00069; A63B 21/00192; A63B 21/225; A63B 22/06; A63B 22/02; A63B 22/0012; A63B 22/0005; A63B 21/0051; A63B 21/4047; A63B 23/1209
(Continued)

(56) References Cited

U.S. PATENT DOCUMENTS 3,139,241 A * 6/1964 Johnson ..... A01K 89/0275 192/39
3,232,554 A * 2/1966 Johnson ..... A01K 89/0102 242/258
(Continued)

FOREIGN PATENT DOCUMENTS

CA 2778754 A1 * 6/2012 ..... A63B 29/02
WO WO 2017082990 A1 * 5/2017 ..... B01D 27/08

OTHER PUBLICATIONS

STIC search (Year: 2022).*

*Primary Examiner* — Megan Anderson
(74) *Attorney, Agent, or Firm* — Campbell IP; Dutro E. Campbell, II

(57) ABSTRACT

The present invention provides an upper body exercise apparatus that is portable, is compatible with various other workout machines such as stationary bikes and treadmills and is advantageous for safe, low-impact cardiovascular exercise. The exercise apparatus comprises a pair of movable handlebars that are activated by push and pull forces exerted by the user. A clamp sub-assembly is provided by which a user may attach the exercise apparatus to a separate free-standing machine, such as a stationary bike or a treadmill. A brake sub-assembly is also provided and serves to create a braking effect that results in a feeling of resistance to the user as the user moves the handlebars in a substantially forward or rearward direction.

3 Claims, 14 Drawing Sheets

(51) Int. Cl.
*A63B 21/005* (2006.01)
*A63B 21/22* (2006.01)
*A63B 22/02* (2006.01)
*A63B 22/06* (2006.01)
*A63B 23/12* (2006.01)

(52) U.S. Cl.
CPC ..... *A63B 21/0051* (2013.01); *A63B 21/225* (2013.01); *A63B 21/4047* (2015.10); *A63B 22/0005* (2015.10); *A63B 23/1209* (2013.01); *A63B 21/4035* (2015.10); *A63B 22/02* (2013.01); *A63B 22/06* (2013.01)

(58) Field of Classification Search
USPC ..... 482/51
See application file for complete search history.

(56) References Cited

U.S. PATENT DOCUMENTS 3,966,201 A * 6/1976 Mester ..... A63B 23/0355 482/62
4,477,071 A * 10/1984 Brown ..... A63B 23/03541 482/73
4,621,805 A * 11/1986 Chen ..... A63B 22/0005 403/93
4,625,963 A * 12/1986 Lancellotti ..... A63B 23/03533 482/130
4,826,152 A * 5/1989 Lo ..... A63B 22/0012 482/114
D324,894 S * 3/1992 Porcello ..... D21/679
5,138,893 A * 8/1992 Copeland ..... B62K 21/125 74/551.8
5,246,410 A * 9/1993 Fun ..... A63B 22/0012 482/53
5,282,776 A * 2/1994 Dalebout ..... A63B 22/0056 482/52
5,319,995 A * 6/1994 Huang ..... B62K 21/125 74/551.8
5,374,225 A * 12/1994 Wilkinson ..... A63B 23/03533 482/29
5,720,698 A * 2/1998 Dalebout ..... A63B 22/0056 482/52
5,833,574 A * 11/1998 Hsieh ..... A63B 22/0056 434/255
6,003,405 A * 12/1999 Giard ..... B62K 21/125 74/551.8
6,926,645 B1 * 8/2005 Stearns ..... A63B 22/0012 601/36
7,569,000 B2 * 8/2009 Wang ..... A63B 22/0023 482/54
7,918,767 B1 * 4/2011 Wilson ..... A63B 23/03575 482/92
8,088,048 B2 * 1/2012 Tsai ..... A63B 22/001 482/96
8,764,615 B2 * 7/2014 Wang ..... A63B 21/152 482/1
10,279,210 B2 * 5/2019 Ky ..... A63B 21/151
11,097,762 B1 * 8/2021 Collins ..... B62B 5/064
11,447,169 B2 * 9/2022 Sklenar ..... B62B 9/20
2002/0142898 A1 * 10/2002 Willis ..... A63B 21/1609 482/904
2002/0160889 A1 * 10/2002 Lederman ..... A63B 22/02 482/54
2006/0148622 A1 * 7/2006 Chen ..... A63B 21/153 482/121
2006/0293153 A1 * 12/2006 Porth ..... A63B 21/4047 482/52
2006/0293154 A1 * 12/2006 Graber ..... A63B 22/0664 482/52
2007/0037668 A1 * 2/2007 Cofrin ..... A63B 21/0618 482/51
2007/0184937 A1 * 8/2007 Graber ..... A63B 22/0664 482/52
2009/0118106 A1 * 5/2009 Leisenring ..... A63B 21/4035 482/121
2009/0131227 A1 * 5/2009 Stevenson ..... A63B 22/0005 482/51
2009/0253559 A1 * 10/2009 Maresh ..... A63B 21/00181 482/93
2009/0291804 A1 * 11/2009 Stearns ..... A63B 24/00 482/8
2010/0056348 A1 * 3/2010 James ..... A63B 21/16 482/127
2011/0281690 A1 * 11/2011 Van Straaten ..... A63B 22/0046 482/52
2012/0180831 A1 * 7/2012 April ..... A45B 11/00 135/16
2014/0213414 A1 * 7/2014 Balandis ..... A63B 21/169 482/111
2016/0001126 A1 * 1/2016 Yeh ..... A63B 23/1263 482/92
2017/0014661 A1 * 1/2017 Lin ..... A63B 21/005
2019/0160327 A1 * 5/2019 Wilson ..... A63B 1/005
2019/0282852 A1 * 9/2019 Dalebout ..... A63B 23/03575
2020/0101342 A1 * 4/2020 Lawton ..... A63B 21/4033
2020/0262463 A1 * 8/2020 Villarreal ..... B62B 9/206
2021/0113885 A1 * 4/2021 Maresh ..... A63B 22/0292
2022/0233911 A1 * 7/2022 Johnson, III ..... A63B 21/00192

* cited by examiner

ARM EXERCISE ATTACHMENT

STATEMENT REGARDING FEDERALLY SPONSORED RESEARCH OR DEVELOPMENT

The present invention was made with no government support.

RELATED PATENT APPLICATIONS AND INCORPORATION BY REFERENCE

Not applicable

FIELD OF THE INVENTION

The present invention is directed generally to exercise equipment. More specifically, the present invention is directed to a unique portable push/pull exercise apparatus that is adapted to permit the user to work muscle groups in the upper body, particularly the arm muscles, and to also concurrently perform cardiovascular exercise.

BACKGROUND OF THE INVENTION

For years, the obesity epidemic has plagued the United States and obesity rates are continuing to increase worldwide. Some estimates approximate over 33% of adults and over 20% of children and adolescents in the United States are obese. Undoubtedly, obesity is one of the most significant and challenging public health issues in today's world.

Although poor diet and overeating are general causes of obesity, lack of exercise and inactivity are believed to be the primary drivers for the continuous rise in obesity rates. Physical activity can help people maintain a healthy weight or lose unwanted excess weight. Regular exercise provides a variety of benefits, including lowering the risk of heart disease, stroke, Alzheimer's disease, osteoporosis, high blood pressure, cancer, and other diseases. Moreover, regular exercise helps reduce stress, elevates mood, improves cognitive function, benefits joint health, increases circulation leading to healthier skin and may also help sexual function.

There is a vast array of exercise equipment available for use at home and in commercial gyms as a means for staying active and getting regular exercise. However, many of the exercise machines known in the art, such as treadmills and stationary bikes, allow for minimal or no arm movement and provide no upper body workout.

Known exercise machines that feature both upper and lower body movement and exercise are generally cost-prohibitive and can only be used in one fixed location.

A need exists for an exercise apparatus that provides an upper body workout, takes up minimal space, is compatible with lower body workout machines, is portable, and is easy and inexpensive to manufacture.

SUMMARY OF THE INVENTION

In view of the above, it is an object of the present invention to overcome the shortfalls in the related art by presenting an improved exercise apparatus.

An objective of the present invention is also to provide an exercise apparatus that facilitates performing an upper body workout.

Another objective of the present invention is to provide an exercise apparatus that is compatible with other exercise machines to facilitate performing a full-body workout that optimizes calorie burning efficiency.

A further objective of the present invention is to provide an exercise apparatus that is portable and adaptable to be easily attached to and detached from a separate conventional exercise machine, such as a stationary bike or treadmill.

Yet another object of the present invention is to provide an exercise apparatus with adjustable resistance function, allowing for resistance variability.

The exercise apparatus according to the present invention comprises a base frame, a pair of handlebars in pivotal communication with the base frame, a clamp sub assembly for attaching the apparatus to a free-standing exercise machine, such as a stationary bike or treadmill, and a brake sub assembly for providing resistance against movement of the handlebars.

DETAILED DESCRIPTION

Figure 1:
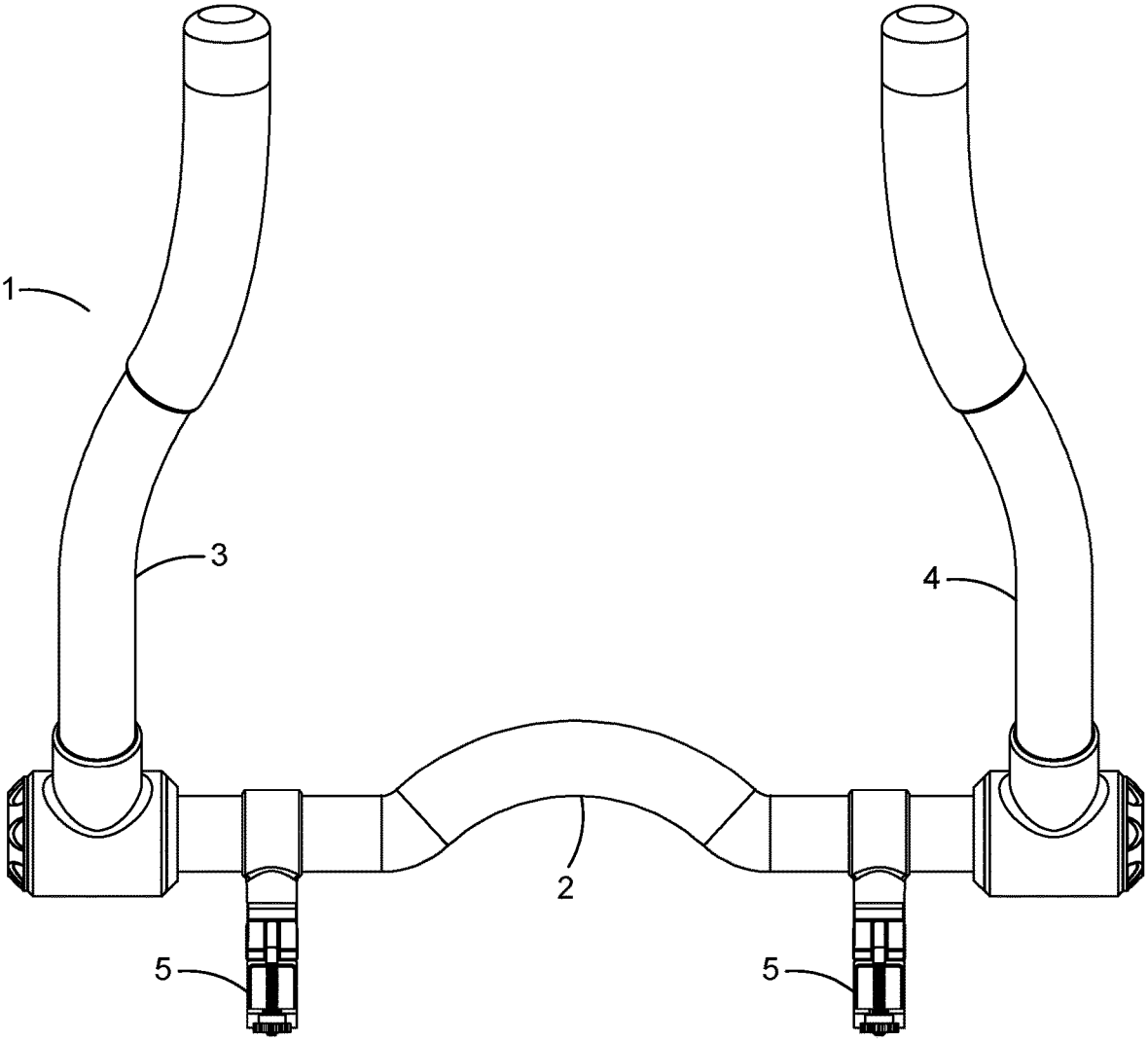
FIG. 1 is front view of an embodiment of the present invention.

The following detailed description is merely exemplary in nature and is not intended to and should not be interpreted to limit the embodiments described herein. Although particular embodiments are described, those embodiments are merely exemplary implementations of the system of the present invention. The following descriptions and illustrations herein should be considered illustrative in nature, and thus, not in any way limiting the scope of the present invention. One skilled in the art will recognize other embodiments are possible and all such embodiments are intended to fall within the scope of the present disclosure. While the preferred embodiments are described with reference to the above drawings, there is no intent to limit the disclosure to the embodiments shown in the drawings or disclosed herein. Rather, the intent is to include all alternatives, modifications and equivalents that embody the spirit and scope of the disclosure.

It is also to be understood that the disclosure uses terminology for the purpose of describing particular embodiments and such terminology is not intended to be limiting.

Unless defined otherwise, all technical and scientific terms used in this disclosure have the same meaning as commonly understood by one of ordinary skill in the art to which is applicable to this disclosure.

As will be apparent to those of skill in the art upon reading this disclosure, each of the embodiments described and illustrated herein has discrete components and features which may be readily separated or combined with features of any of the other possible embodiments without departing from the spirit and scope of the present disclosure.

Referring to the drawings more particularly by reference number, reference number 1 refers to an exercise apparatus in accordance with the present invention. The exercise apparatus 1 is designed for use as an attachment to exercise machines that lack any means for the user to perform an upper body workout. An illustrative exercise apparatus 1 of the present invention is shown in FIG. 1.

As shown in the embodiment illustrated in FIG. 1, the exercise apparatus 1 has a base frame 2 and two opposing handlebars 3, 4. The base frame 2 and two opposing handlebars 3, 4 are formed of metal, preferably a metal such as aluminum. Other metals, stainless steel or other materials conventionally used to form exercise equipment may be suitable as well. The opposing handlebars 3,4 are pivotally mounted upon opposite ends of the base frame 2 and are actuated by the user grasping the respective handlebars 3, 4 and moving his or her arms in a substantially forward and reverse direction.

Figure 2:
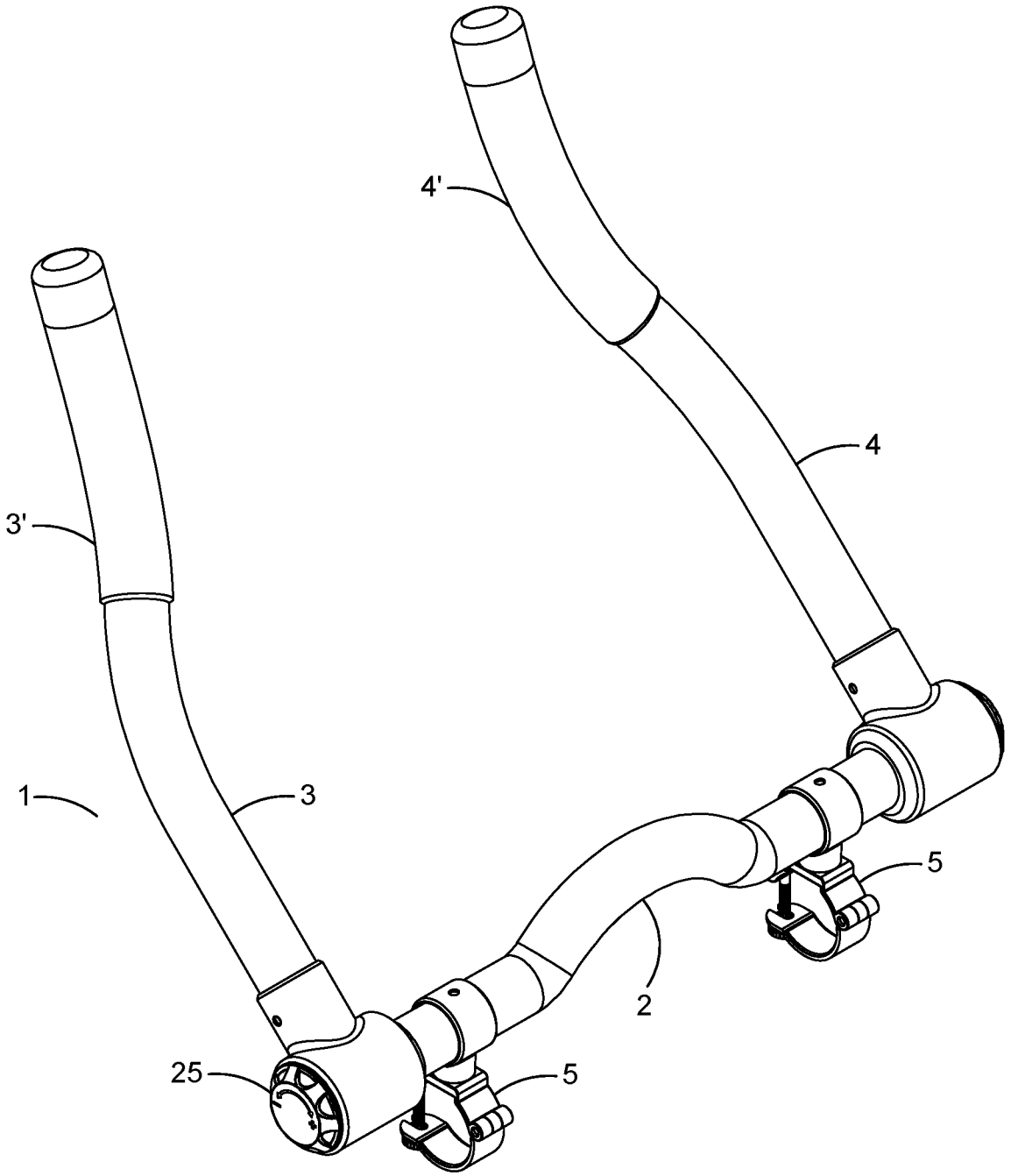
FIG. 2 is a perspective view of an embodiment of the present invention.
Figure 6:
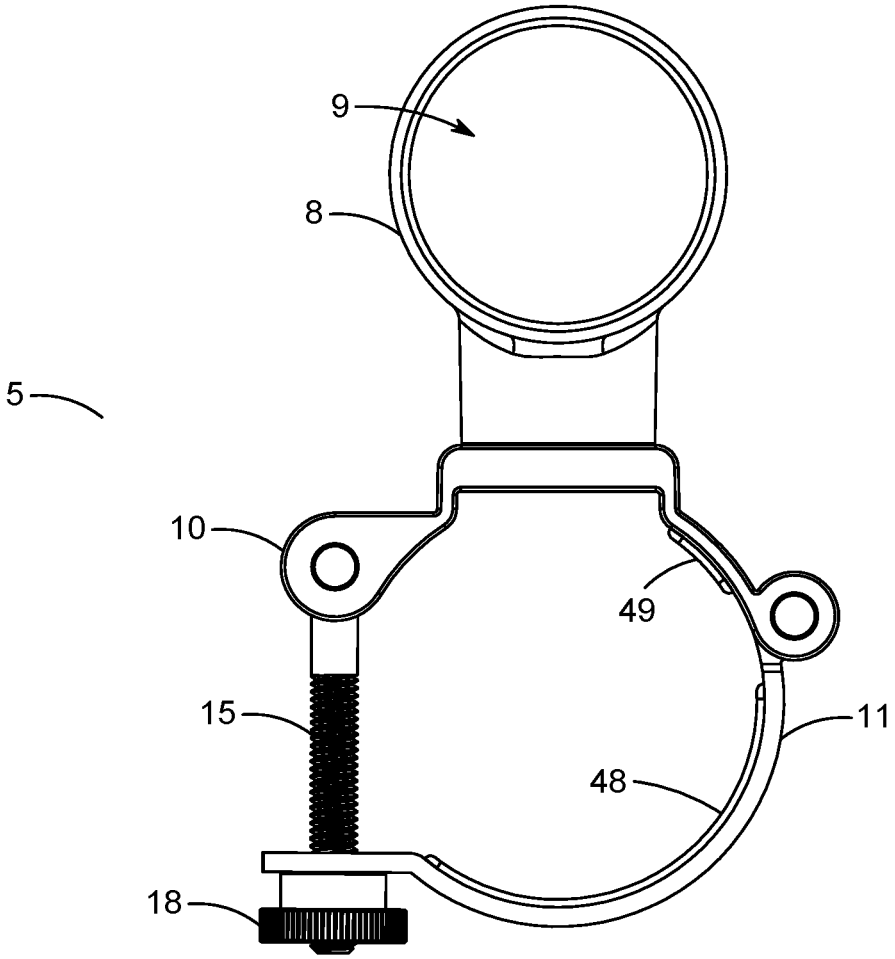
FIG. 6 is a side view of a clamp sub-assembly of an embodiment of the present invention.
Figure 7:
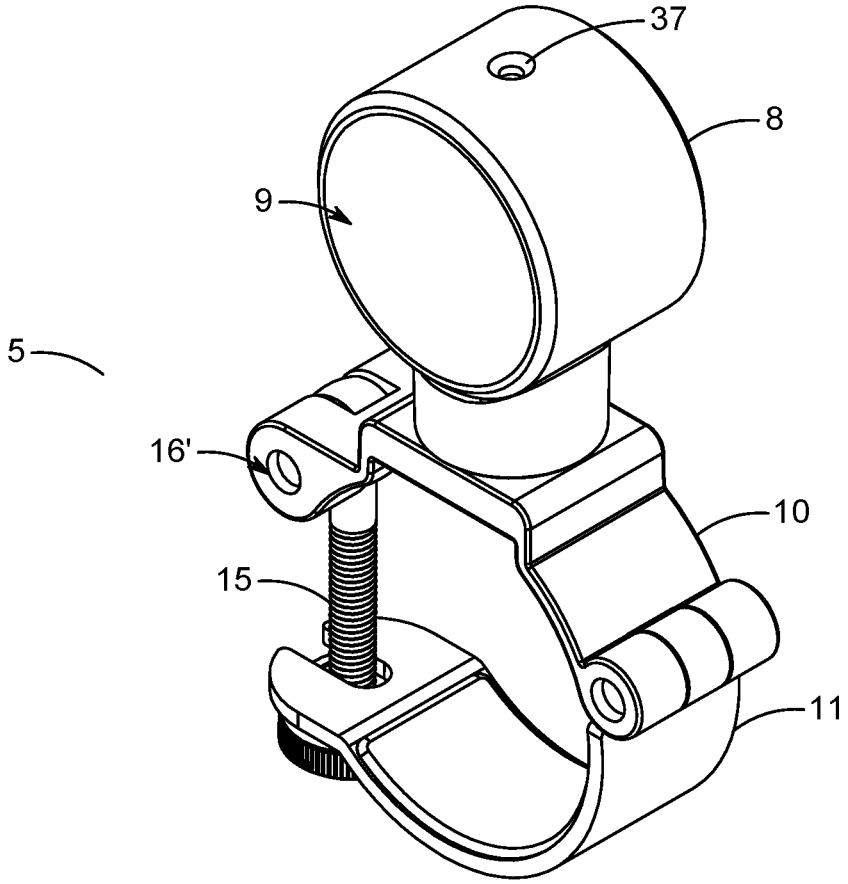
FIG. 7 is a perspective view of a clamp sub-assembly of an embodiment of the present invention.
Figure 8:
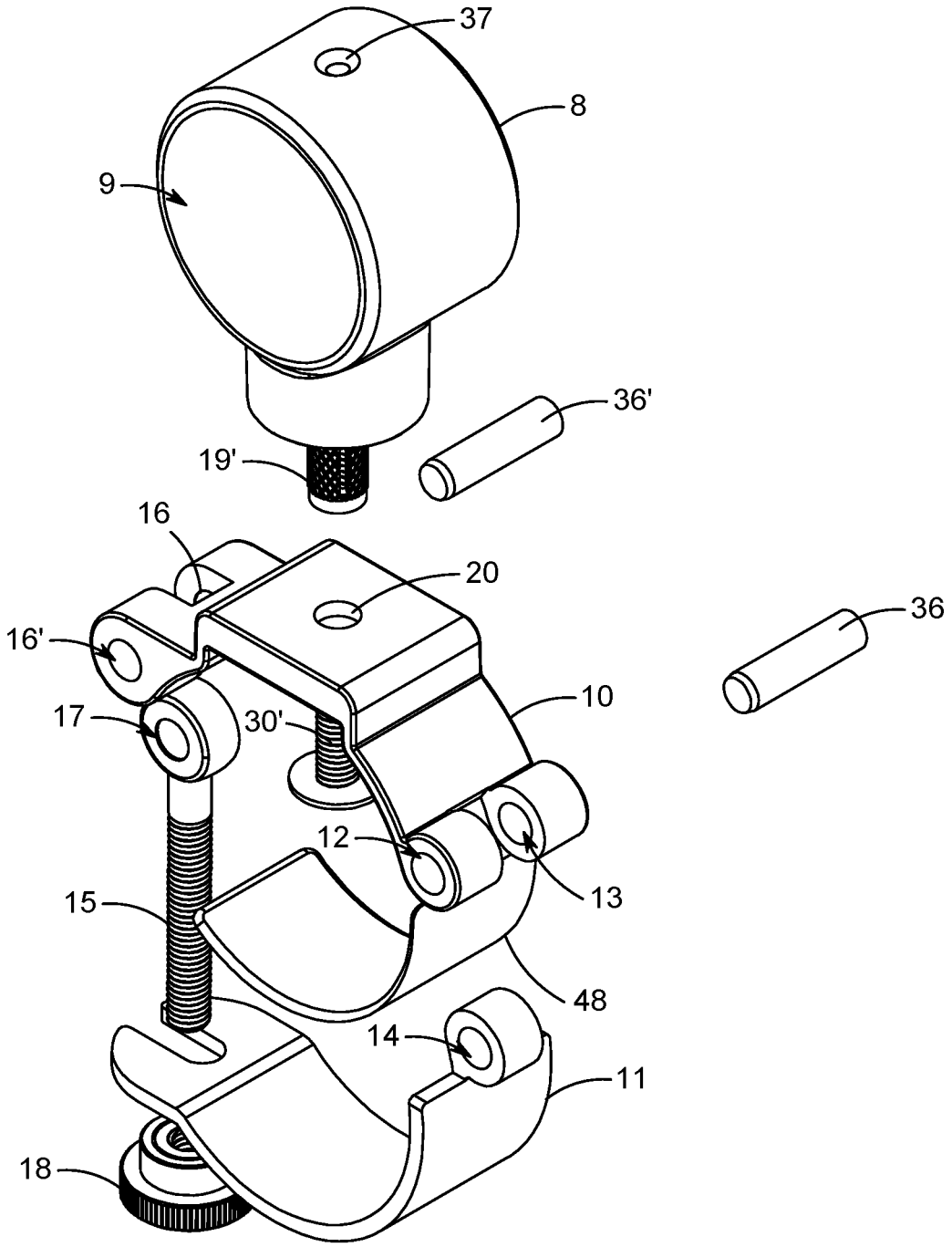
FIG. 8 is an exploded view of a clamp sub-assembly of an embodiment of the present invention.

As further shown in FIG. 1, two identical clamp sub-assemblies 5 are provided, one at each opposing end of the base frame 2, to facilitate attachment of the exercise apparatus 1 to a standard exercise machine, such as a treadmill or stationary bike (not shown). The clamp sub-assembly 5 is preferably formed of a thermoplastic, such as polycarbonate/acrylonitrile butadiene styrene (PC-ABS). With reference to FIGS. 6-8, the clamp sub-assembly 5 includes a bar clamp connector 8 having a channel 9 through which the base frame 2 is received to hold the clamp sub-assembly 5 in place and to secure it to the base frame 2. As shown in FIG. 3B, the bar clamp connector 8 has an aperture 37 that, when the exercise apparatus 1 is fully assembled as shown in FIG. 2, corresponds to a threaded bore 39 in the base frame 2 and through which a screw 38 may be screwed to secure each clamp sub-assembly 5 to the base frame 2. It is also possible that other known connecting devices or methods, such as adhesives or clamps may be used to secure the clamp sub-assemblies 5 to the base frame 2. Further, although the preferred embodiment shown in FIGS. 1 and 2 comprises two clamp sub-assemblies 5, any number of clamp sub-assemblies 5 (i.e., one or more) may be employed provided they firmly secure the exercise apparatus 1 to the separate exercise machine.

Figure 14:
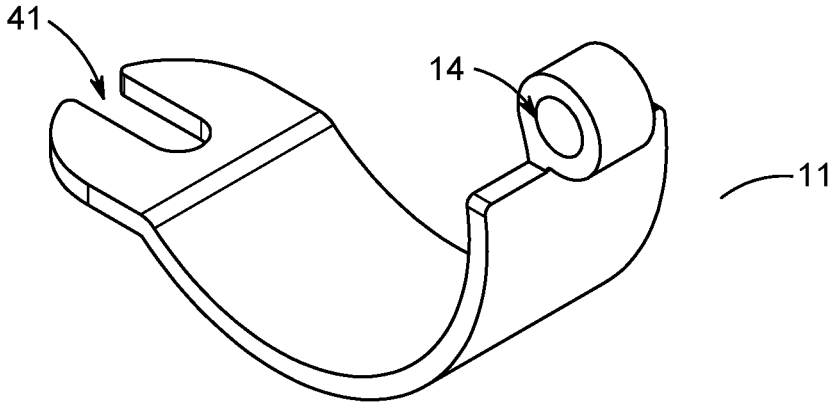
FIG. 14 is perspective view of a bottom clamp of an embodiment of the present invention.

As also shown in FIGS. 6-8, each clamp sub-assembly 5 further comprises a top clamp 10 and bottom clamp 11, which operate together to attach or clamp the exercise apparatus 1 to a separate exercise machine. The top clamp 10 and bottom clamp 11 are provided with dowel pin apertures 12, 13, 14, through which a dowel pin 36 is inserted to hold the top clamp 10 and bottom clamp 11 in place. The clamp sub-assembly 5 further comprises a threaded rod end bolt 15 for adjusting the clamping forces applied by the top and bottom clamps 10, 11. The top clamp 10 is provided with an additional pair of dowel pin apertures 16, 16'. A dowel pin 36' is inserted through these additional dowel pin apertures 16, 16' and a corresponding aperture 17 of the rod end bolt 15, thus securing the rod end bolt 15 to the top clamp 10, as shown in FIG. 7. As shown in FIGS. 7 and 8, the distal end of the rod end bolt 15 is slotted through a slot 41 (shown in FIG. 14) in a lip portion of the bottom clamp 11. A fastener 18, preferably a nut (as shown in FIG. 8), engages the distal end of the rod end bolt 15 and can be adjusted by rotating in a clockwise or counterclockwise manner to alternatively tighten or loosen the top clamp 10 and bottom clamp 11. Adjusting the fastener 18 to tighten the top clamp 10 and bottom clamp 11, results in the application of the necessary clamping force to secure the exercise apparatus 1 to a separate exercise machine. The design of the clamp sub-assembly 5, specifically the adjustability of the bottom clamp 11 relative to the top clamp 10 as described herein, advantageously allows the exercise apparatus 1 to be secured to exercise machine parts of various sizes. When the fastener 18 is removed entirely, the bottom clamp 11 can be adjusted into an open position to allow the clamp sub-assembly 5 to engage a part of a separate exercise machine, such as the handlebars of a stationary bike for example, to which the exercise apparatus 1 will be attached. The bottom clamp 11 can then be repositioned into a closed position, as shown in FIGS. 6 and 7, and the fastener 18 may be re-engaged with the rod end bolt 15 and tightened to secure the clamp sub-assembly 5 firmly to the separate exercise machine.

In the embodiment shown in FIGS. 6-8, the top clamp 10 is secured to the bar clamp connector 8 by means of a brass-fit expansion insert 19' that at one end is inserted into an aperture (not shown) in the bar clamp connector 8. The opposite end of the brass-fit expansion insert 19' is inserted into a hole 20 on the top surface of the top clamp 10. A threaded button-head cap screw 30' is screwed into the brass-fit expansion insert 19' to securely affix the bar clamp connector 8 to the top clamp 10. It should be understood other suitable connecting devices may be used to attach the bar clamp connector 8 to the top clamp 10. As also shown in FIGS. 6 and 8, thin foam pads 48, 49 may also be adhered to the bottom clamp 11 and top clamp 10, respectively, to provide a secure and tight clamp to the separate exercise machine and to prevent damage to the separate exercise machine. Any known adhesive, such as glue, may be used to adhere the foam pads 48, 49 to the clamp sub-assembly.

Figure 9:
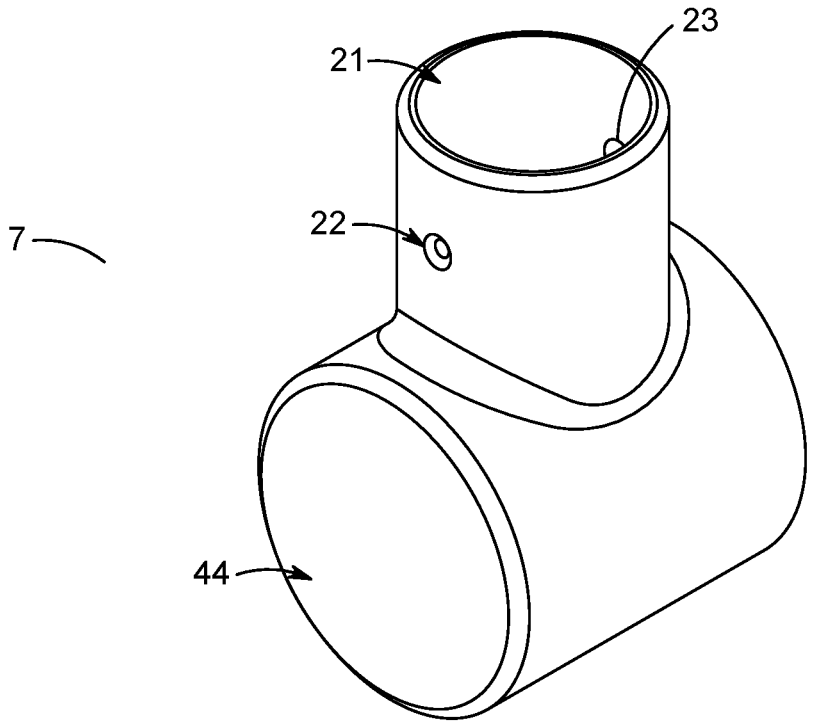
FIG. 9 is a perspective view of a handlebar connecter of an embodiment of the present invention.

Turning now to FIGS. 1, 2, 3A and 9, a handlebar connector 7 is shown, one of which is mounted at each opposite end of the exercise apparatus 1. The handlebar connectors 7 are preferably formed of a thermoplastic, such as PC-ABS. Each handlebar connector 7 may advantageously be formed as a one-piece integral unit, as shown in FIG. 9, having a channel 44 through which the brake sub-assembly 6 is received and a second channel 21 through which a corresponding handlebar 3, 4 is received. Referring to FIGS. 3B and 9, each handlebar connector 7 is provided with small holes 22, 23 through which a connector, such as a flat head Phillips screw 43, 43', may be inserted and then screwed into a threaded bore in the respective handlebar 3, 4 to secure the respective handlebar 3, 4 to the corresponding handlebar connector 7. One skilled in the art would understand other known devices and methods of securing the handlebars 3, 4 to the corresponding handlebar connectors 7 may be employed, such as rivets, adhesives, and the like.

FIGS. 1-3A show the right and left handlebars 3, 4 of a preferred embodiment of the invention. As shown in FIG. 2, the respective handlebars 3, 4 may advantageously be fitted with handlebar grips 3', 4' to provide additional grip for the user when operating the exercise apparatus 1. The handlebar grips 3', 4' may be formed of any suitable material, such as NPVC foam.

Figure 3A:
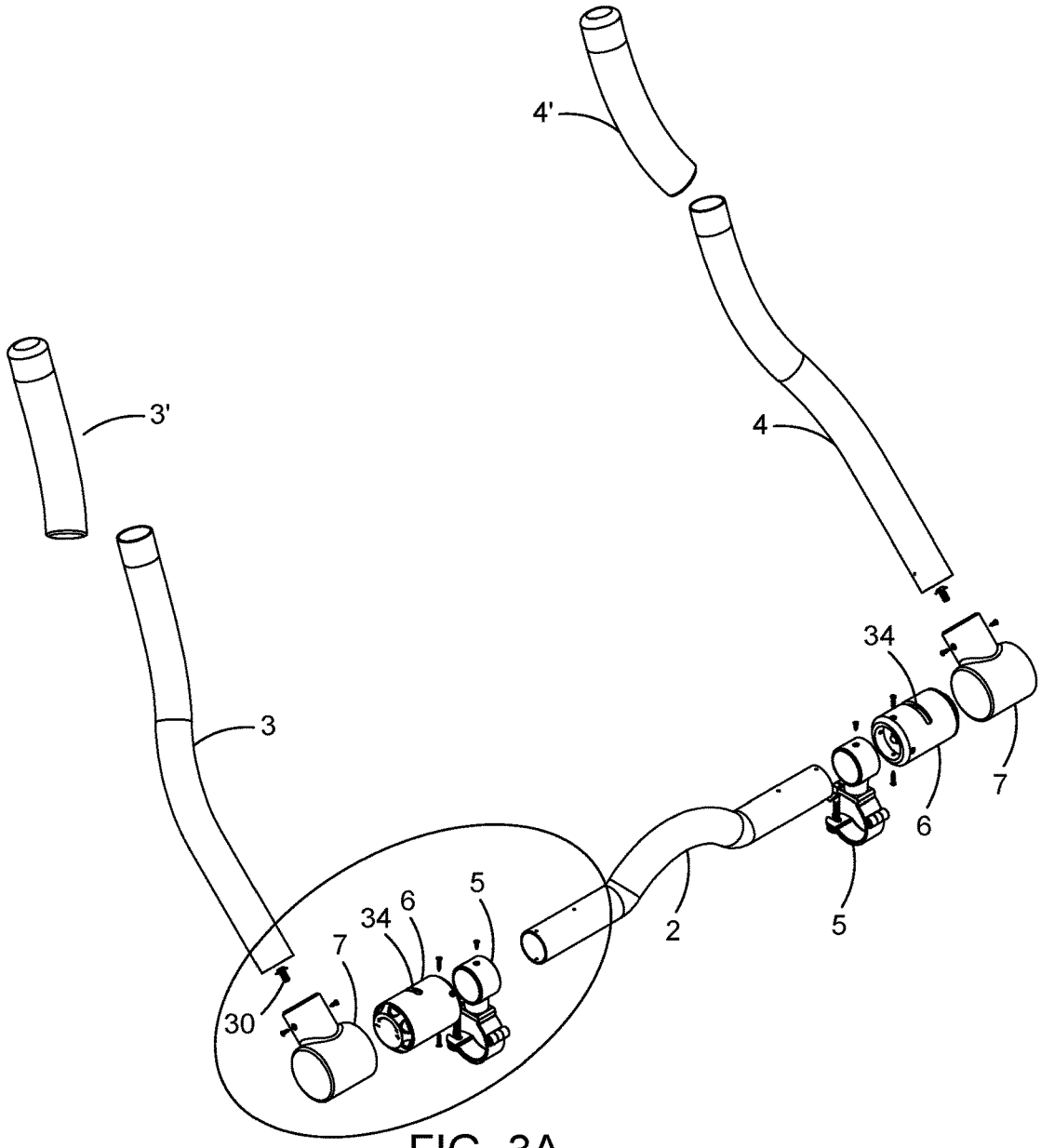
FIG. 3A is an exploded view of an embodiment of the present invention.
Figure 3B:
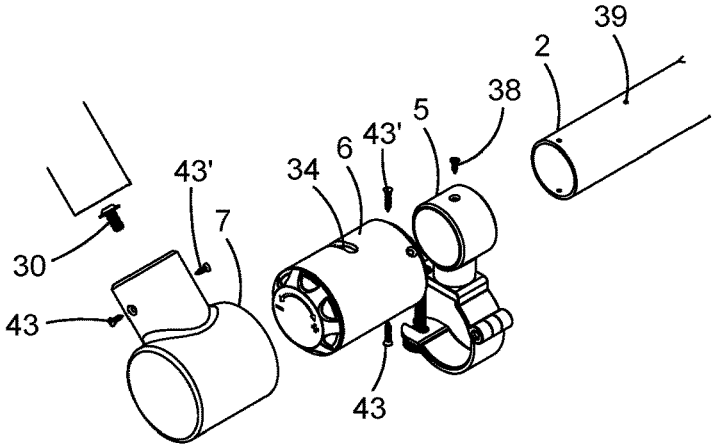
FIG. 3B is an exploded view of a portion of an embodiment of the present invention, showing a portion of a handlebar, a handlebar connector, a brake sub-assembly, a clamp sub-assembly, and portion of the base frame of an embodiment of the present invention.
Figure 4:
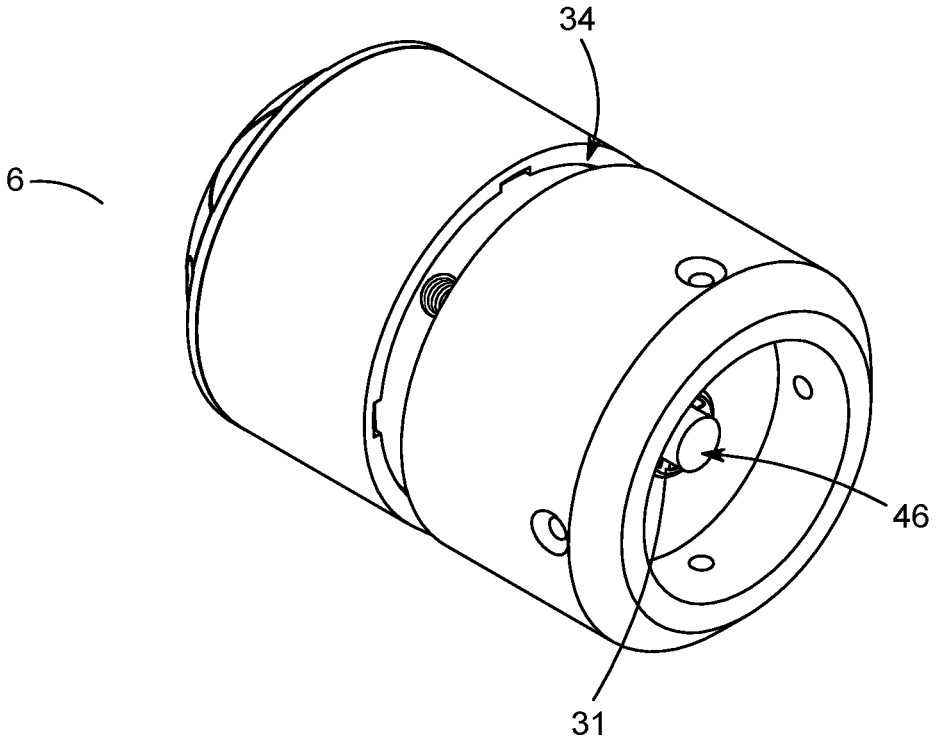
FIG. 4 is a perspective view showing the brake sub-assembly of an embodiment of the present invention.

With reference to FIGS. 3A and 4, the exercise apparatus 1 further comprises a pair of identical brake sub-assemblies 6 affixed at opposing ends of the base frame 2 and designed to support the respective handlebars 3, 4 in a substantially upright and fixed range of positions and to further provide adjustable rotational resistance of the handlebars 3, 4. As shown in FIGS. 1-3B, each opposing end of the base frame 2 is slotted through one of the bar clamp connector channels 9, further inserted into the open side of a corresponding brake sub-assembly 6 and secured to the corresponding brake sub-assembly 6 using two screws 43, 43'.

Figure 5:
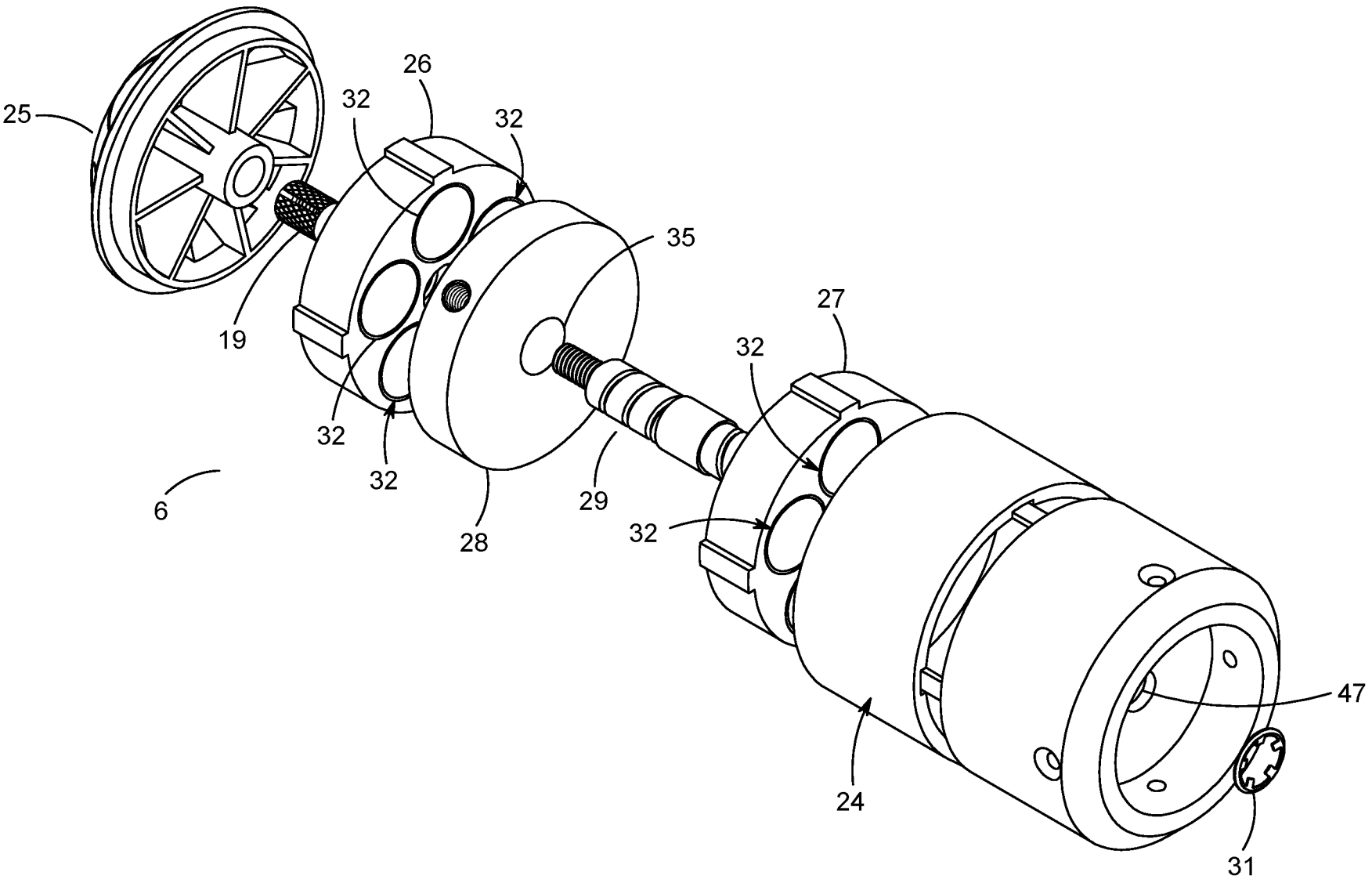
FIG. 5 is an exploded view showing the brake sub-assembly of an embodiment of the present invention.

Each brake sub-assembly 6 of the preferred embodiment shown in FIGS. 4 and 5 comprises a nylon bearing 24, a resistance dial 25, a pair of magnet holders 26, 27, a flywheel 28, a dial drive shaft 29, a brass press-fit expansion insert 19, a push-on external retaining ring 31, and magnets 32. As shown in FIGS. 2, 3A, 3B, 11 and 18, when the handlebar connector 7 is secured in place over the corresponding brake sub assembly 6, a threaded button-head cap screw 30 is inserted through a hole (not shown) in the handlebar connector 7 and further through a slot 34 in the nylon bearing 24 and finally screwed into a threaded hole 33 in the corresponding flywheel 28 (see FIG. 11), thereby affixing the handlebar connector 7 to the corresponding flywheel 28. With the handlebar connectors 7 thusly secured to the corresponding flywheels 28 and with the handlebars 3, 4 each secured to a respective handlebar connector 7, as described above, each handlebar 3, 4 can be moved by the user in a substantially forward and rearward direction in concert with the rotation of the corresponding flywheel 28. The handlebar connector 7 and flywheel 28 rotate together, but independently of the rest of the brake sub-assembly 6, limited only by the slot 34 length in the nylon bearing 24.

Figure 10:
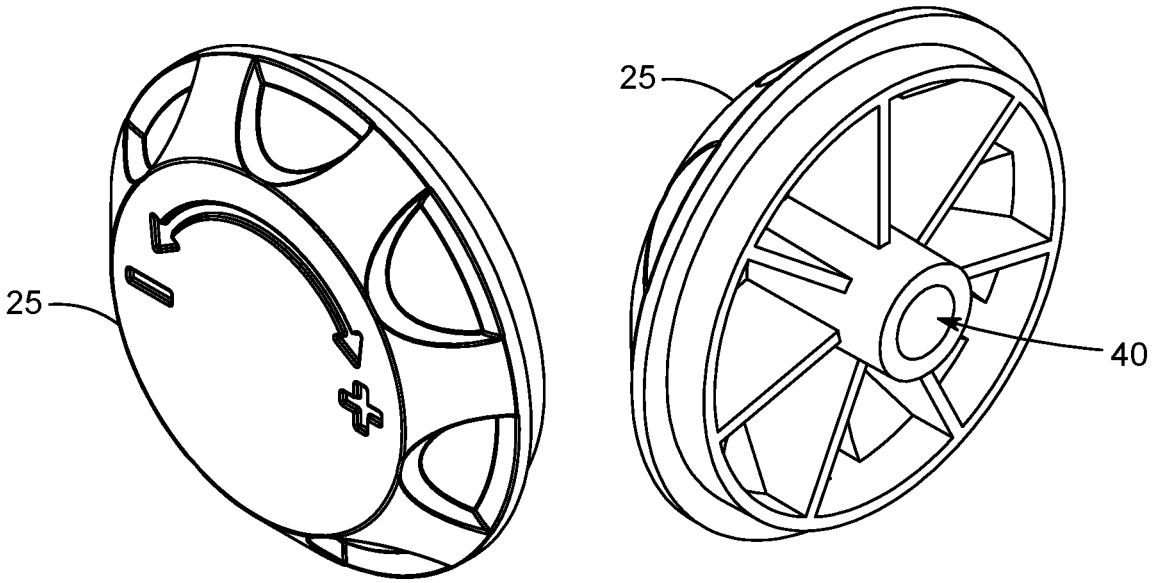
FIG. 10 is a perspective view of a pair of resistance dials of an embodiment of the present invention.
Figure 11:
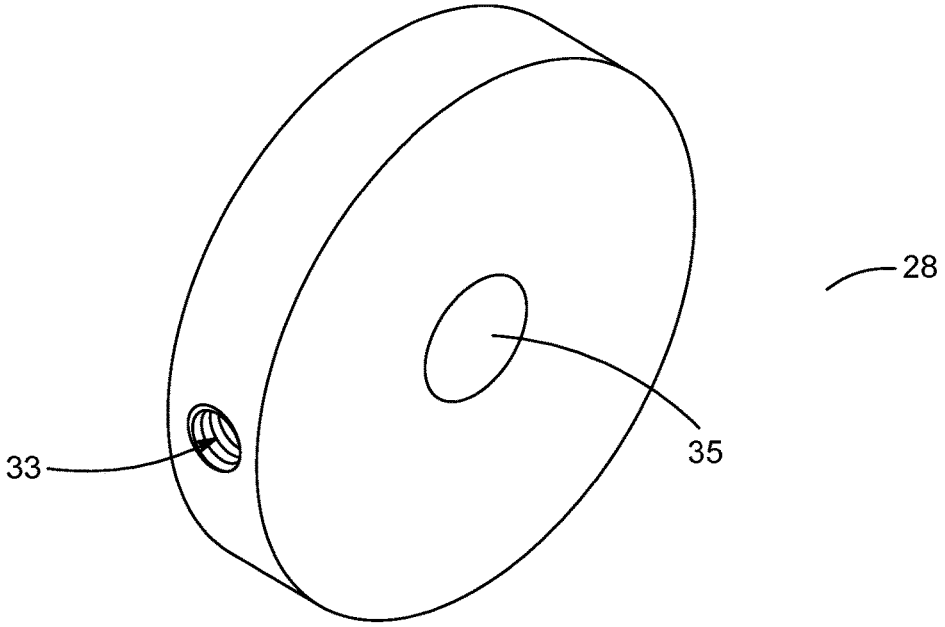
FIG. 11 is a perspective view of a flywheel of an embodiment of the present invention.
Figure 12:
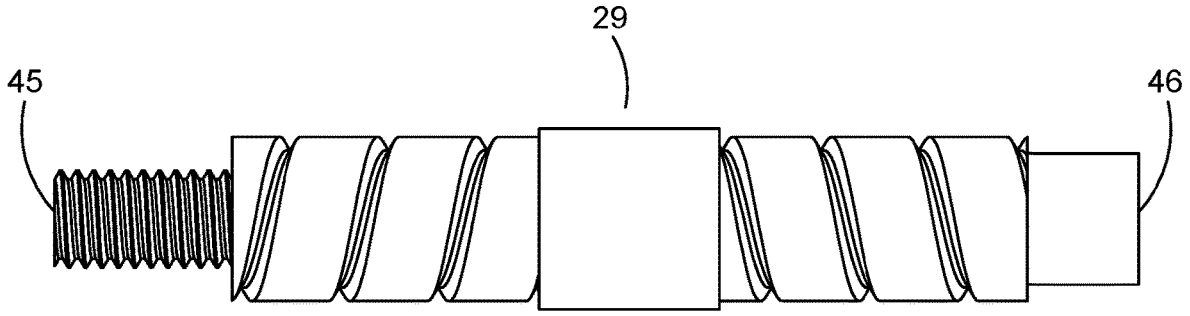
FIG. 12 is a side view of a dial drive shaft of an embodiment of the present invention.
Figure 13:
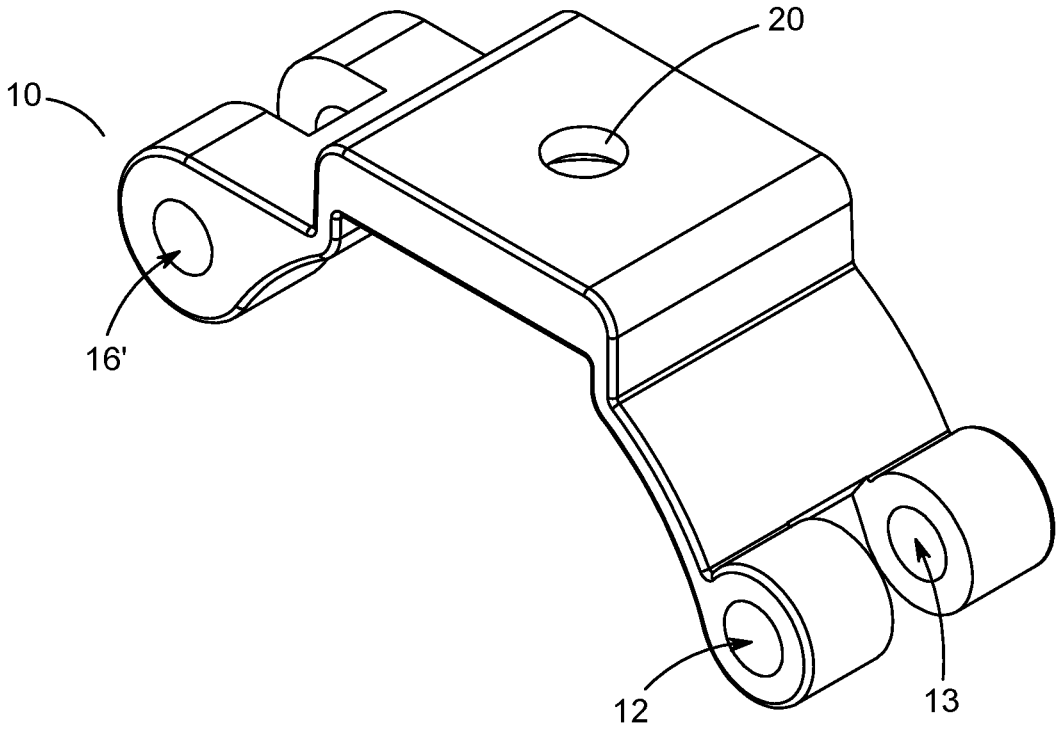
FIG. 13 is a perspective view of a top clamp of an embodiment of the present invention.
Figure 15:
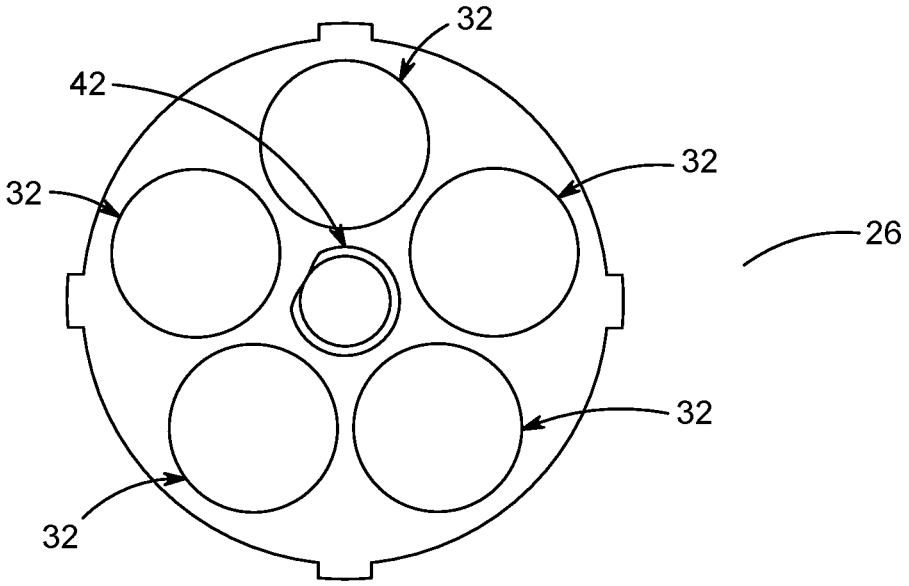
FIG. 15 is a side view of a magnet holder of an embodiment of the present invention.
Figure 16:
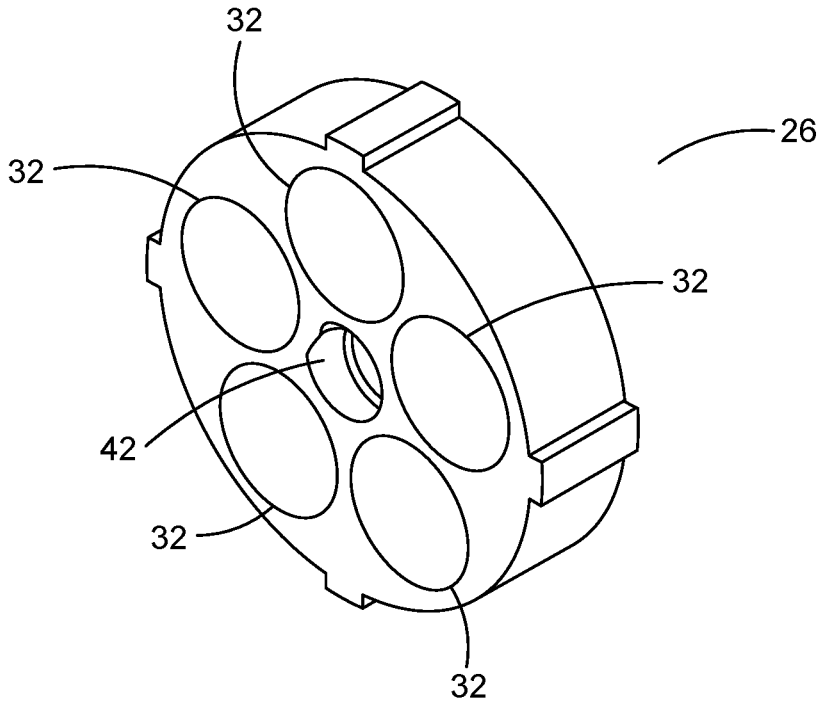
FIG. 16 is a perspective view of a magnet holder of an embodiment of the present invention.
Figure 17:
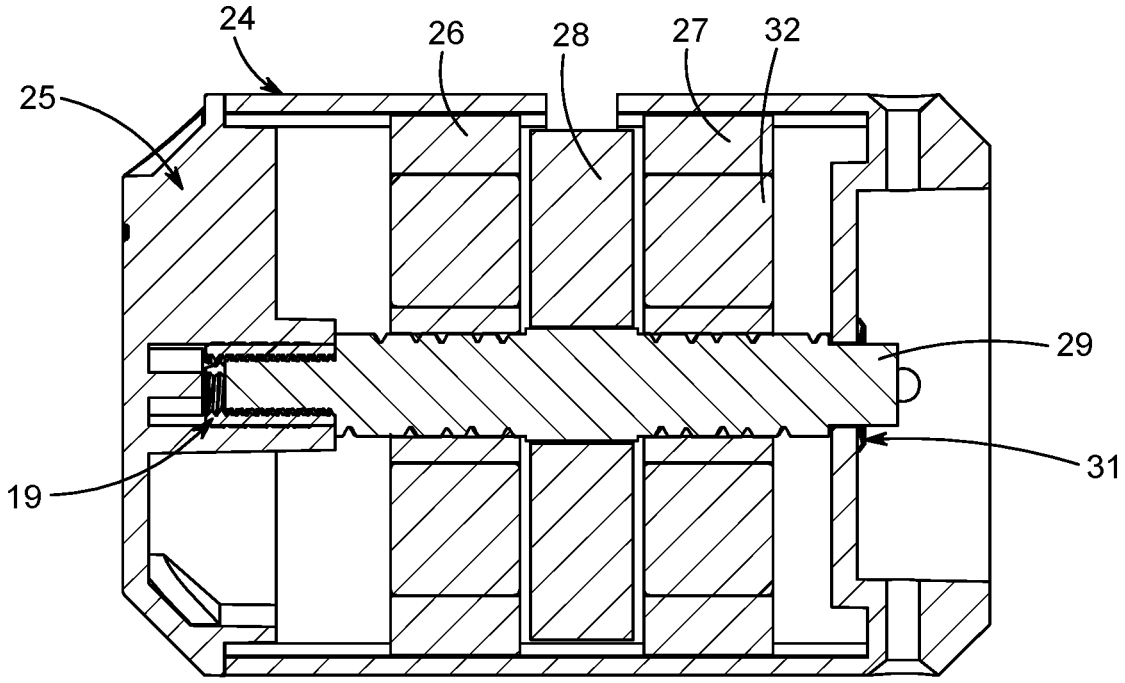
FIG. 17 is a side cross section view of a brake sub-assembly of an embodiment of the present invention.
Figure 18:
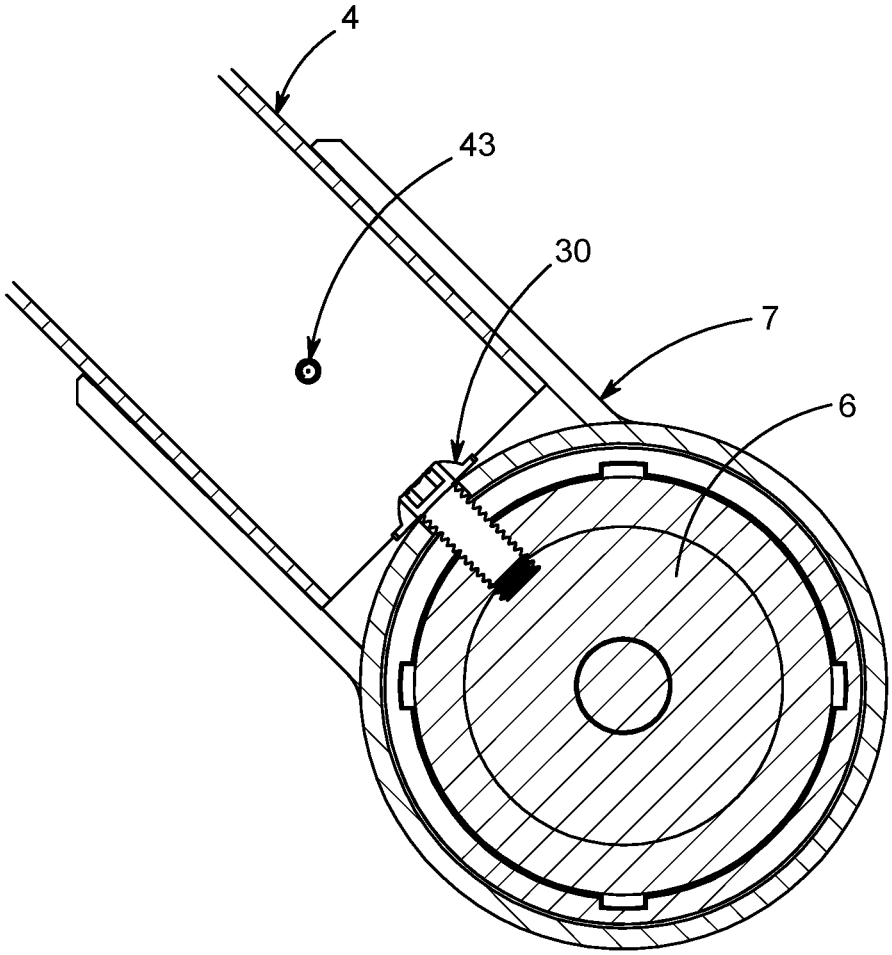
FIG. 18 is a front cross section view of a brake sub-assembly of an embodiment of the present invention.

As shown in FIGS. 5 and 17, the brake sub-assembly comprises a central flywheel 28 made of electrically conductive material, preferably a metal such as aluminum. A hole 35 is provided in the flywheel 28 through which the dial drive shaft 29 is received. In the preferred embodiment shown in FIG. 5, the two magnet holder plates 26, 27 each hold five high strength Neodymium magnets 32. Although the preferred embodiment comprises five high strength Neodymium magnets 32 in each magnet holder plate 26, 27, one skilled in the art would understand the present invention may employ any number of magnets and may alternatively further employ other types of magnets of similar strength to Neodymium. Referring to FIGS. 15 and 16, the two magnet holder plates 26, 27 each have a central thread 42 cut either clockwise and counterclockwise, respectively, that corresponds to threads on the drive shaft 29. Further, linear grooves in the inside of the nylon bearing 24 prevent the magnet holder plates 26, 27 from rotating, but allow the magnet holder plates 26, 27 to move laterally (i.e., closer together or further apart) within the nylon bearing 24. The drive shaft 29 (shown in FIG. 12) is attached to the resistance dial 25, which may be actuated by the user to adjust the resistance of the handlebar 3, 4 movement. In the preferred embodiment shown in FIG. 5, the drive shaft's distal end 46 (shown in FIG. 12) is threaded and may be screwed into a brass press-fit expansion insert 19 that is, in turn, inserted into an aperture 40 in the resistance dial 25 (shown in FIG. 10), thus securing the drive shaft 29 to the resistance dial 25. As the user turns the resistance dial 25, the drive shaft 29 is rotated and causes the space between the magnet holder plates 26, 27 to increase or decrease depending on the direction of the resistance dial 25 rotation. The magnets 32 create a magnetic field between the magnets 32 on the respective opposing magnet holder plates 26, 27, the strength of which is increased or decreased depending on the distance between the magnet holder plates 26, 27. In use, the flywheel 28 is rotated in relation to the magnets 32 passing through the various magnetic fields, thereby resulting in a magnetic friction force that is relative to the speed of the flywheel 28 movement and the magnetic field strength. This magnetic friction force causes a braking effect that creates a feeling of resistance to the user as the user moves the handlebars 3, 4 in a substantially forward or rearward direction. Accordingly, manipulation of the resistance dial 25 increases or decreases the rotational resistance of the flywheel 28, thus increasing or decreasing the force required to move the handlebars 3, 4 in a substantially forward and reverse direction. As shown in shown in FIGS. 4 and 5, the proximal end 46 (shown in FIG. 12) of the drive shaft 29 protrudes through an opening 47 in the nylon bearing 24 and engages a push-on external retaining ring 31 that helps secure the drive shaft 29 in place.

Having described the preferred embodiment of the present invention, any number of changes, variations and improvements which may be apparent to those skilled in the art are within the scope of the invention claimed and described herein. For example, the manner in which the various components of the present invention are attached to one another is not limited to the particular manner described above. As various changes could be made in the above constructions without departing from the scope of the invention, it is intended that all matter contained in the above description or shown in the accompanying drawings shall be interpreted as illustrative and not limiting in any manner.

What is claimed is:

1. An exercise apparatus comprising:

a base frame;

two handlebars in pivotal communication with said base frame;

one or more clamp sub-assemblies affixed to said base frame for attaching the exercise apparatus to a separate piece of exercise equipment; and two brake sub-assemblies operatively communicating with said two handlebars and adapted to control a resistance of movement of said two handlebars, wherein each of said two brake sub-assembly comprises a nylon bearing, a resistance dial, a pair of magnet holders, a flywheel, a dial drive shaft and magnets.

2. The exercise apparatus according to claim 1, wherein said magnets are formed of high strength Neodymium.

3. The exercise apparatus according to claim 1, wherein said magnets create magnetic fields and each said flywheel is rotated in relation to the magnets passing through the magnetic fields, thereby resulting in a magnetic friction force that is relative to a speed of a flywheel movement and strength of the magnetic fields and creating a braking effect that creates a feeling of resistance as said two handlebars are moved by a user of said exercise apparatus.

* * * * *